US006142076A

United States Patent [19]

Corrado et al.

[11] Patent Number: 6,142,076

[45] Date of Patent: Nov. 7, 2000

[54] APPARATUS AND METHOD FOR CLEANING A WEB SUBSTRATE

[76] Inventors: Frank C. Corrado, 33 Gateway Rd., Rochester, N.Y. 14624; James W. Fischer, 118 Bellhurst Dr., Rochester, N.Y. 14617; Gary R. Larsen, 726 Eastwood Cir., Webster, N.Y. 14580; Ronald W. Sweet, 2234 E. Lake Rd., Conesus, N.Y. 14435

[21] Appl. No.: 09/137,892

[22] Filed: Aug. 20, 1998

[51] Int. Cl.[7] ..... B41F 35/00

[52] U.S. Cl. ..... 101/425; 101/423

[58] Field of Search ..... 101/425, 423, 101/424; 15/256.53, 256.52, 256.51, 256.5, 104.002

[56] References Cited

U.S. PATENT DOCUMENTS

| | | | |
|---|---|---|---|
| 3,851,582 | 12/1974 | Sauerssig et al. | 101/424.1 |
| 3,999,239 | 12/1976 | Misuna | 15/256.52 |
| 4,953,252 | 9/1990 | Akisawa | 15/256.51 |
| 5,611,281 | 3/1997 | Corrado et al. | 101/425 |
| 5,642,670 | 7/1997 | Takeuchi | 101/424 |
| 5,685,043 | 11/1997 | LaManna et al. | 15/256.51 |
| 5,813,073 | 9/1998 | Korbonski | 15/256.52 |

FOREIGN PATENT DOCUMENTS

| | | | |
|---|---|---|---|
| 63-204728 | 8/1988 | Japan | 15/256.51 |

*Primary Examiner*—John S. Hilten
*Assistant Examiner*—Anthony H. Nguyen

[57] ABSTRACT

A system for cleaning a web surface including an axially oscillable contact cleaning roller (CCR) positionable to be in contact with the web surface on a free-span of the web. The CCR, which may be mounted in a frame, enjoys a wrap angle greater than 0° and may also be positionable to be out of contact with the web for renewal of the CCR surface. The increased CCR wrap angle can improve the efficiency of particle removal relative to a nipped CCR installation. Either the frame or the roller itself is oscillable such that the CCR may be moved transversely of the web while in rolling contact with the web surface to distribute particles associated with the edges of the web over a broader area of the CCR. Preferably, the ratio of oscillation velocity to web velocity is less than about 0.01 and preferably the web tension is greater than about 0.5 pounds per inch of web width. Plastic and paper webs having a thickness as low as about 0.001 inch may be readily cleaned without wrinkling. Existing CCR web cleaning installations having backing rollers may be readily modified and simplified to provide free-span CCR cleaning in accordance with the present invention.

8 Claims, 5 Drawing Sheets

APPARATUS AND METHOD FOR CLEANING A WEB SUBSTRATE

DESCRIPTION

The present invention relates to methods and apparatus for cleaning particulate contamination from a moving web, and more particularly to methods and apparatus for using a contact cleaning roller to pick up particles from a web surface.

In many manufacturing processes, for example, in continuous-web printing and in the coating of photographic films and papers, particulate contamination of the web surface can lead to reduced quality of the coated product and to increased waste.

It is known to use a polymer-covered roller in rolling contact with a web to remove particles from the surface of the web ahead of the printing or coating point. The surface of such a roller (known in the art as a contact cleaning roller and also referred to herein as a CCR), has high surface energy. The CCR surface exhibits a greater attraction for particles than does the web surface, so that particles are transferred from the web to the CCR at the point of rolling contact.

A CCR may function as a conveyance roller in a string of web conveyance rollers, in which use the CCR typically enjoys a substantial angle of wrap of the web, for example, a wrap angle of 90° or even greater. A conveyance roller as used herein is a roller whose position defines a portion of a web conveyance path. In such an installation, the CCR is said to engage the web on a "free span" (without backing roller) between two adjacent conveyance rollers. Such engagement by a CCR may be on either side of the web being conveyed. See, for example, U.S. Pat. No. 5,251,348 issued Oct. 12, 1993 to Corrado et al.

A CCR may also function as a non-conveyance roller, that is, the web conveyance path is not a function of the presence or absence of the CCR. In such use, a CCR typically is positioned as a nip roller urged against a conveyance roller (backing roller), the web passing therebetween, whereby the web is conveyed on a first or back side against the conveyance roller and is cleaned on a second or front side by the CCR. See, for example, U.S. Pat. No. 5,611,281 issued Mar. 18, 1997 to Corrado et al. which is hereby incorporated by reference.

Many webs have particulate contamination on one or both surfaces concentrated along the outer edges, which can lead to premature clogging and failure of a full-width CCR while large portions of the CCR surface are still non-clogged and serviceable. The U.S. Pat. No. 5,611,281 patent discloses to prolong the useful life of a CCR between renewals (removal of accumulated particles) by oscillating the CCR axially while it is rolling along the web surface, thereby causing accumulating particles to be distributed as a broad band over a substantial portion of the axial length of the roller along each web edge.

In the prior art for causing a CCR to be oscillated transversely of a web during contact cleaning, the web must be nipped between the CCR and a backing roller, i.e., the CCR may not function as a conveyance roller while being oscillated. This requirement can increase significantly the cost and complexity of a CCR installation, since a mounting frame and at least one additional roller (the backing roller) are needed for each cleaning step, and also typically an electromechanical positioning means for engaging and disengaging the CCR and backing roller. Such an installation may cost substantially more than a free-span CCR installation, which may be fixed in oscillable bearings on a machine frame and may not require any engaging actuation. Even where actuation is required, the lack of one or more backing rollers makes a free-span installation inherently less expensive.

Thus there is a need for a method and apparatus for providing oscillatory axial motion of a CCR transversely of a web in contact with the CCR when the CCR is disposed as a conveyance roller on a free span of the web path.

Further, when both surfaces of a web must be cleaned by oscillating CCRs, the known art requires apparatus, such as is shown in FIG. 8 of U.S. Pat. No. 5,611,281. The invention provides a method and apparatus for providing oscillatory CCR cleaning of either or both surfaces of a web, which provides advantages of effectively cleaning the web and of simplification which can reduce cost.

It is a principal object of the invention to provide an improved method and apparatus for inexpensive and simple oscillatory CCR cleaning of a web.

It is a further object of the invention to provide an improved method and apparatus wherein an oscillable CCR enjoys the benefit of a significant web wrap angle.

It is a still further object of the invention to improve CCR cleaning methods and apparatus by using a plurality of CCRs, at least one being of higher tack from the others, which higher tack CCR can clean the other CCRs.

Briefly described, a cleaning system embodying the invention includes at least one contact cleaning roller mounted for rotation on a frame. The CCR is positionable to be in contact with a surface of a free-span web to be cleaned over a wrap angle greater than zero degrees and may also be positionable to be out of contact with the web for renewal of the CCR surface. Either the frame or the roller itself is controllably oscillable axially of the CCR such that the CCR may be moved transversely of the web while in rolling contact with the web surface, preferably at a ratio of oscillation velocity to web velocity of less than about 0.01 and preferably at a web tension of greater than about 0.5 pounds per inch of web width. Plastic and paper webs having a thickness as small as about 0.001 inch may be readily cleaned.

The foregoing and other objects, features, and advantages of the invention, as well as presently preferred embodiments thereof, will become more apparent from a reading of the following description in connection with the accompanying drawings in which.

Figure 1:
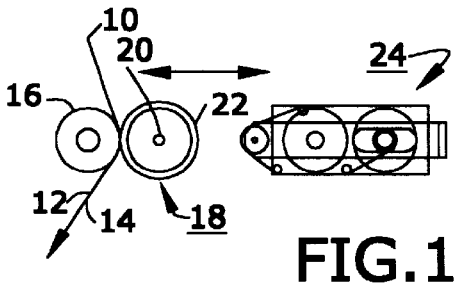
FIG.1 (PRIOR ART)
FIG. 1 is a schematic elevational view of a prior art CCR cleaning assembly, showing a CCR in nipped cleaning relationship against a moving web supported by a backing roller.
Figure 2:
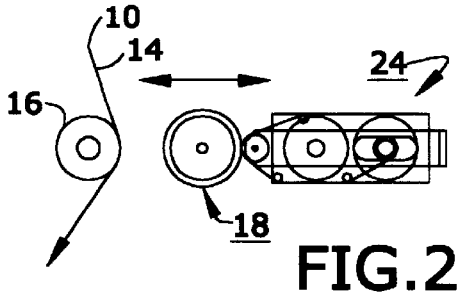
FIG.2 (PRIOR ART)
FIG. 2 is a schematic elevational view like that shown in FIG. 1, showing the CCR repositioned from a web cleaning position to a renewal position, the CCR being in contact with prior art renewal apparatus.
Figure 4:
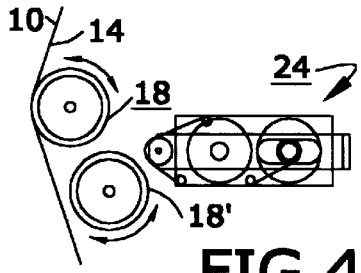
FIG.4 (PRIOR ART)
Figure 5:
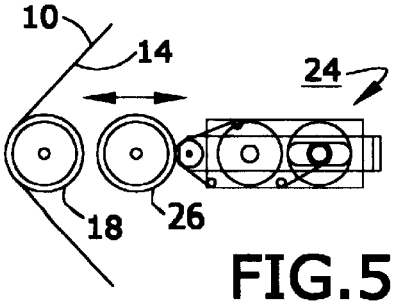
Figure 6:
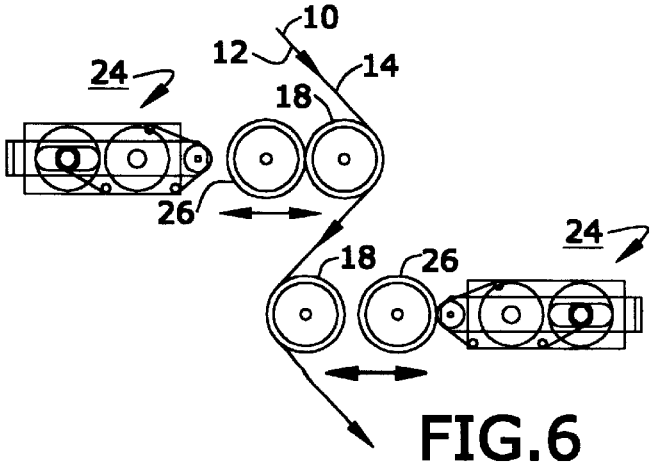
Figure 7:
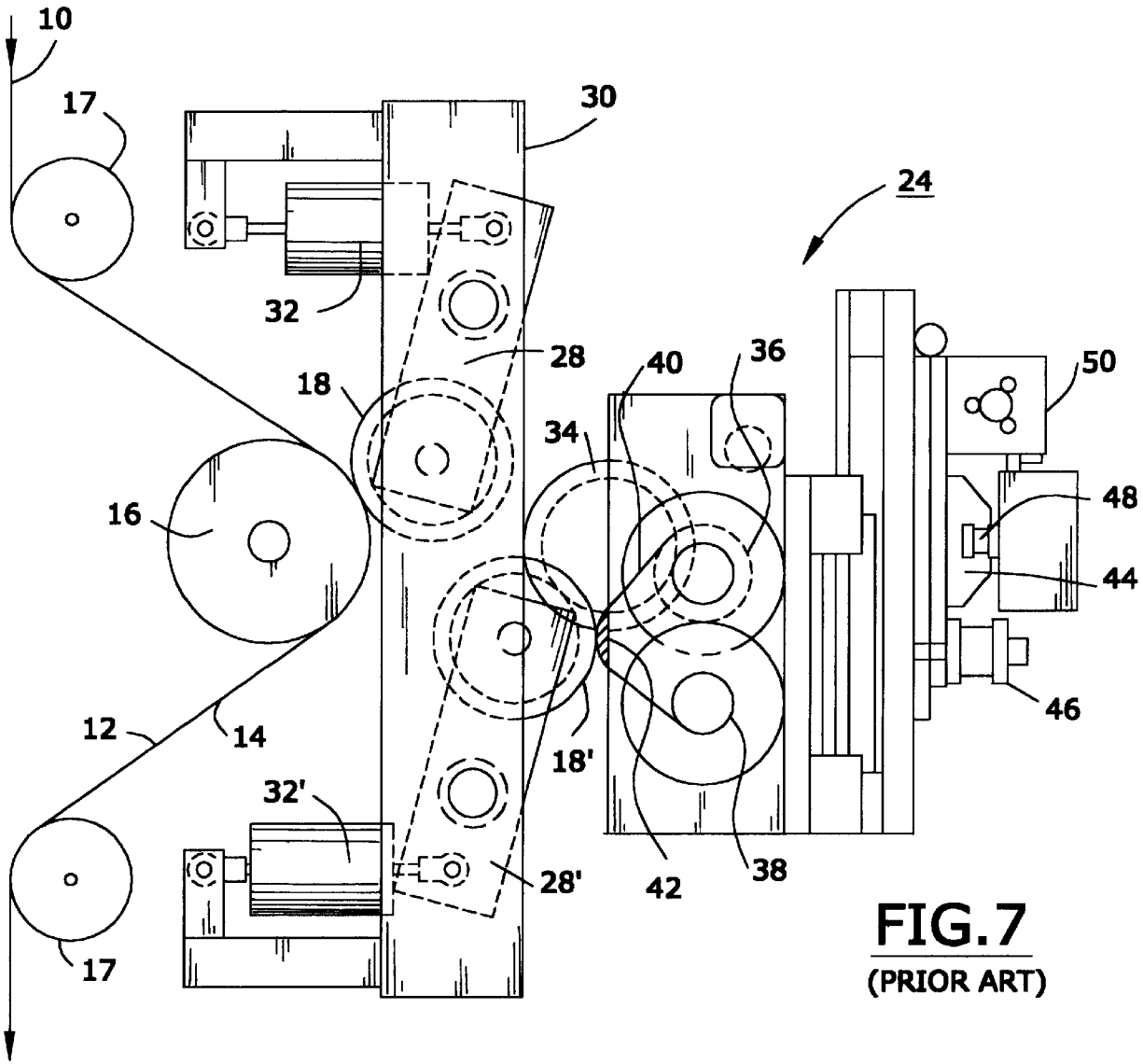
FIG. 7 (PRIOR ART)
Figure 8:
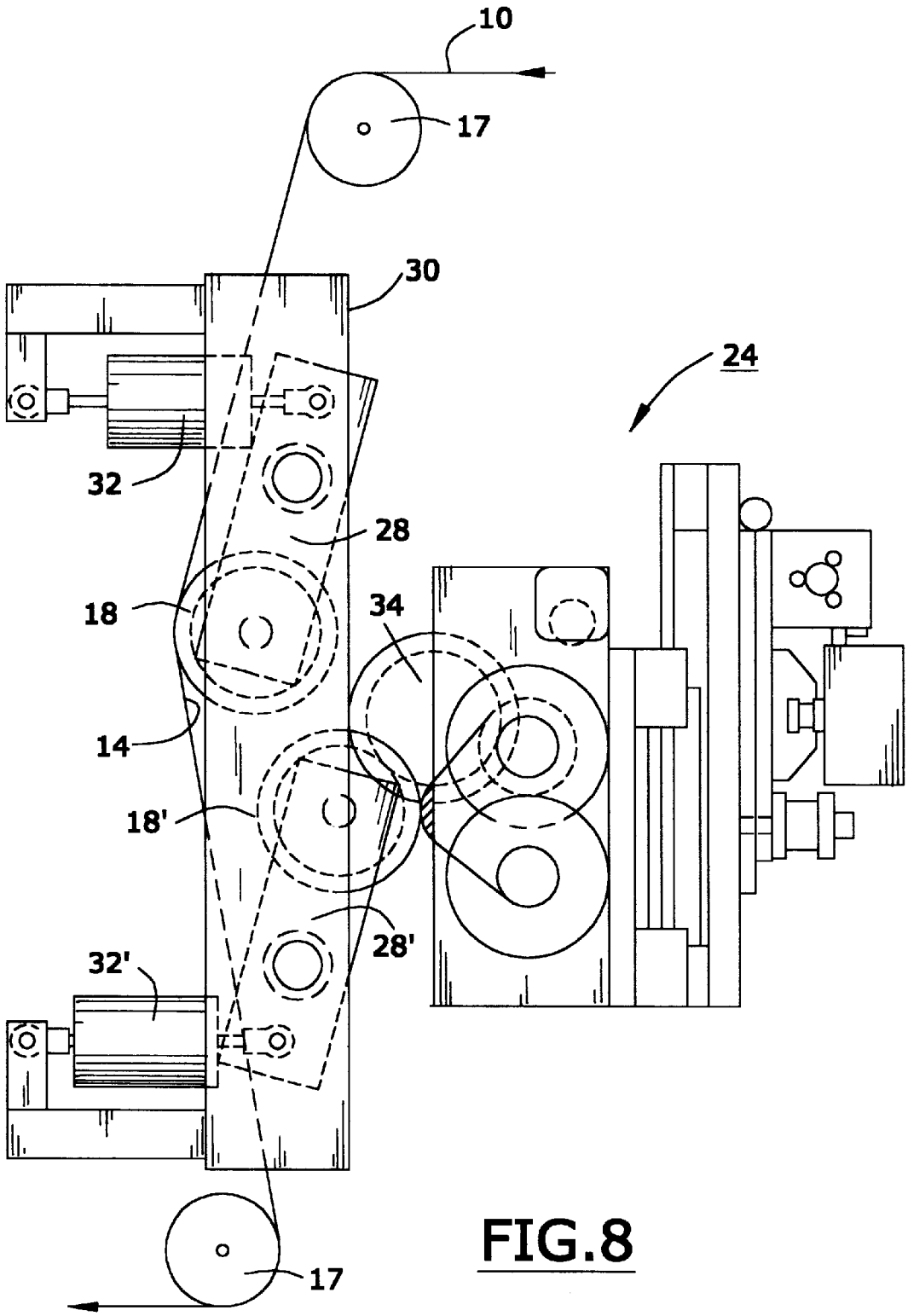
Figure 9:
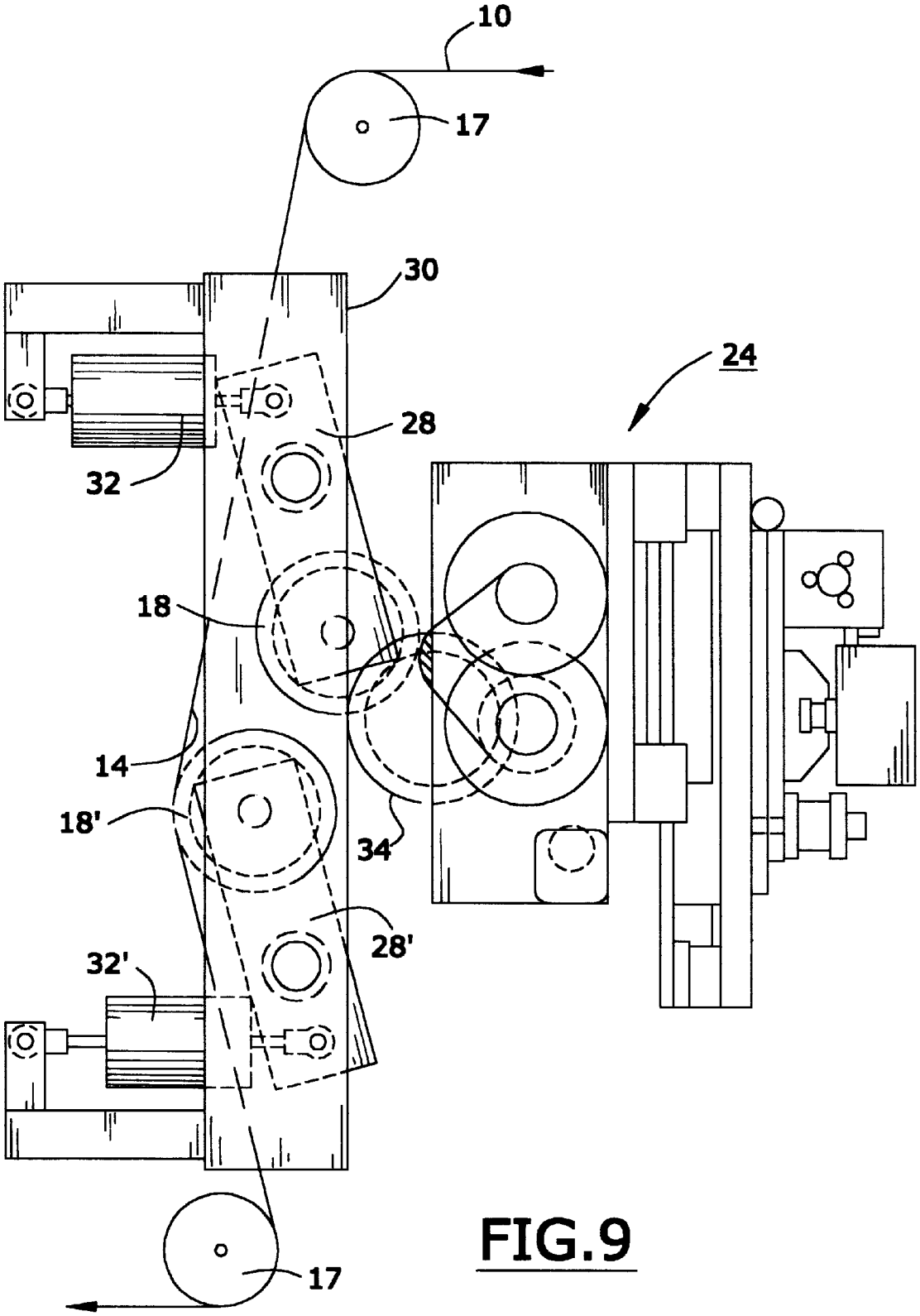
Figure 10:
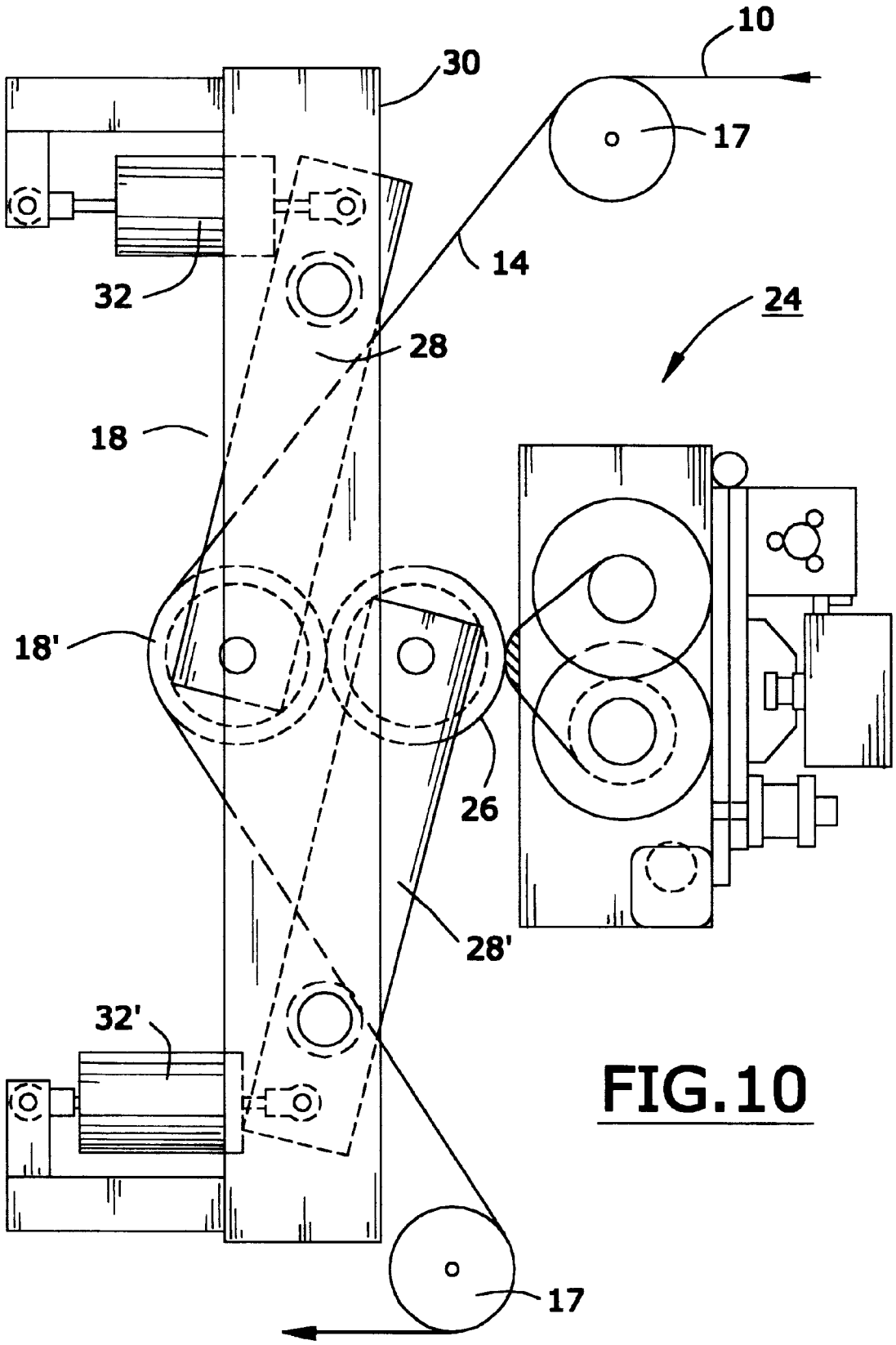

FIG. 4 is a schematic elevational view of a prior art web cleaning assembly showing two pivotable CCRs which may be alternated on a web free-span to permit renewal of each CCR without interruption in web cleaning, in accordance with U.S. Pat. No. 5,251,348;

FIG. 5 is a schematic elevational view of a web cleaning assembly, showing a first, low-tack CCR in position for cleaning a web on a free-span thereof, a second, higher-tack CCR which is positionable against the low-tack CCR for renewal thereof, and a prior art CCR renewal apparatus like that shown in FIGS. 1–4 for renewing the higher-tack CCR;

FIG. 6 is a schematic elevational view of a pair of web cleaning assemblies, each like the assembly shown in FIG. 5, arranged to clean opposite surfaces of the web during a single pass of the web through the apparatus;

FIG. 7 is a detailed elevational view of a prior art web cleaning assembly combining the assemblies shown schematically in FIGS. 1, 2, and 4, substantially as disclosed in U.S. Pat. No. 5,611,281, wherein the web is supported by a backing roller and wherein the CCRs may be oscillated axially while in rolling contact with the moving web on the backing roller;

FIG. 8 is a detailed elevational view showing a first embodiment in accordance with the present invention to allow simultaneous free-span CCR cleaning of the surface of a moving web and axial oscillation of the CCRs during such cleaning, being substantially a detailed view of apparatus in accordance with the web path shown schematically in FIG. 4;

FIG. 9 is another view of the apparatus shown in FIG. 8, showing alternation of the CCRs to permit renewal of each CCR without interruption in web cleaning; and FIG. 10 is a detailed elevational view showing a second embodiment in accordance with the present invention to allow simultaneous free-span CCR cleaning of the surface of a moving web and axial oscillation of the CCRs during such cleaning, and also providing substantially a detailed view of apparatus in accordance with the web path shown schematically in FIG. 5.

Referring to prior art apparatus in FIG. 1, there is shown a substrate 10 having first and second surfaces 12, 14 being conveyed partially around and in contact with a backing conveyance roller 16. Substrate 10 may be a discontinuous sheet having well-defined leading and trailing edges (not shown), or it may be a substantially continuous web formed from, for example, paper, plastic, or metal as is well known in various web-dependent arts. A contact cleaning roller 18 having a roller core 20 and a polymeric shell 22 is disposed in nipped relationship against surface 14 of moving web 10 for removing particles from surface 14. In this relationship, there is no wrap of the web on the CCR, and transfer of particles must take place virtually instantaneously in the nip. Some particles may fail to transfer.

CCR renewal apparatus 24 is disengaged from CCR 18 while the CCR is in cleaning contact with the web. This is necessary because apparatus 24 is typically a wet-cleaning apparatus for removing particles from the CCR surface, for example, as disclosed as Item 52 in U.S. Pat. No. 5,611,281, and cleaning the CCR while in contact with the web would risk the undesirable transfer of cleaning solution to the web. Thus, in a practical installation there are mechanisms, not shown in FIG. 1, for translating the CCR to engage with either the web, for cleaning, or the renewal apparatus, for renewal, as is shown in FIG. 2. Such an installation requires a backing conveyance roller to control the position of the web during cleaning. This configuration in the known art permits oscillation of the CCR as shown in FIG. 7 and discussed hereinbelow.

Figure 3:
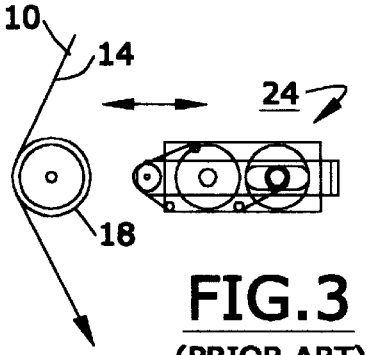
FIG.3 (PRIOR ART)
FIG. 3 is a schematic elevational view of a prior art web cleaning assembly, showing a CCR in web cleaning position on a free span of a web.

A simpler configuration of cleaning apparatus, requiring no backing roller, is shown in FIG. 3, wherein CCR 18 is a conveyance roller fixed against a free span of the web path. An advantage of this configuration over that shown in FIG. 1 is that a substantial wrap angle of greater than 0° can be provided to the web on the CCR, allowing a finite contact time for particle transfer to occur. Thus, a free-span cleaner may be more effective than a nip cleaner at removing particles bound to the web surface. A renewal apparatus 24 may be positioned into and out of engagement with CCR 18, and preferably only dry cleaning of the CCR may be performed for the reasons noted above. To permit wet-cleaning renewal without jeopardizing the web and while maintaining continuous web cleaning, a plurality of CCRs may be provided to alternate between cleaning and renewal, as shown schematically in FIG. 5 and disclosed in U.S. Pat. No. 5,251,348.

Further apparatus for renewing a CCR while cleaning one or both sides of a web on a free span is shown in FIGS. 5 and 6. A transfer CCR 26 having tack higher than that of cleaning CCR 18 may be shuttled between a first position (shown cleaning surface 12 in FIG. 6), wherein it removes particles from CCR 18 as they accumulate from the cleaning of the web surface, and a second position wherein transfer CCR 26 is renewed by a renewal means which may be conventional renewal apparatus 24.

Referring to FIG. 7, a prior art web cleaning installation substantially as disclosed in U.S. Pat. No. 5,611,281, which is incorporated herein by reference, has a backing roller 16 for supporting web substrate 10 in a first web conveyance path including adjacent conveyance rollers 17. First and second CCRs 18,18' are supported on pivot arms 28,28' which in turn are supported on a frame 30. Either the arms or the frame are controllably oscillable axially of the backing roller to oscillate the CCRs transversely of the web conveyance direction, to obtain the benefits of oscillation as disclosed in the '281 patent. CCRs 18,18' may be alternated, each into either a web cleaning position (18) or a CCR renewal position (18'), by controlled action of actuators 32,32'. The CCR in renewal position is driven in rotation by a motorized friction drive wheel 34. Renewal unit 24 has an unwind spindle 36 and a take-up spindle 38 for advancing a cleaning web 40, preferably formed of a durable and mildly-abrasive cloth material or a tacky web such as an adhesive tape. Web 40 passes around, as is urged against CCR 18' by, a resilient pad 42 which may be supplied with a cleaning fluid (not shown) for cleaning and lubrication. Renewal unit 24 is further provided with a rail guide 44, guide roller 46, rail 48, and canted roller drive 50 to permit the unit to be traversed axially of the CCR while renewing.

A significant disadvantage of free-span CCR cleaning installations in the known art is that axial oscillation of a CCR during web cleaning is believed to be impractical, and therefore such installations have not been provided heretofore with oscillatory capability. It is thought that CCR oscillation on a free web span, as opposed to having the web firmly supported through a substantial wrap angle on a backing roller, would cause the web to be driven laterally in the web path or would cause wrinkles, folds, or draw lines in the web, all of which are highly undesirable. Surprisingly, and contrary to common belief, we have found that a CCR may be oscillated on a free web span over a wide range of conveyance conditions without adverse effect on web conveyance or on the web itself. Preferably the angle of wrap on the cleaning CCR is greater than 0° and less than about 180°, preferably between about 10° and about 45°, the web tension in the direction of conveyance during CCR oscillation is greater than about 1.0 pounds per linear inch of web width, and the ratio of oscillation velocity to web velocity is less than about 0.01 and preferably less than about 0.001.

A CCR on a free span may be oscillated axially within the scope of the invention by any convenient means, for example, by a controllable actuator as disclosed in the '281 patent or by a barrel cam as disclosed in pending and allowed U.S. Pat. application, Ser. No. 09/052,687. In the former case, the prior art apparatus shown in FIG. 7 may be retrofitted for oscillable free-span cleaning in either of two configurations corresponding to FIGS. 4 and 5 and shown in detail in FIGS. 8–9, and 10.

Referring to FIGS. 8 and 9, and comparing to FIG. 7, backing roller 16 is eliminated and a modified web path is provided herein web 10 is conveyed through frame 30 and in a free span around both CCRs 18 and 18', either of which may be in cleaning contact with surface 14 of web 10 while the other is being renewed by renewal apparatus 24.

Referring to FIG. 10, and comparing to FIG. 7, backing roller 16 is eliminated and a free-span web path is provided as in FIGS. 8 and 9. However, in addition pivot arms 28,28' are extended so that the CCRs interfere, one CCR being designated as the cleaning CCR and the other as the transfer CCR as shown in FIGS. 5 and 6 and described hereinabove. In such case, the transfer CCR is provided with a higher-tack surface than the cleaning CCR. Control of actuators 32,32' is modified such that the CCRs are urged together and against both the web surface and the renewal apparatus during operation. Preferably, actuators 32,32' are also controlled to separate the CCRs when the rollers are stationary to prevent adherence of the polymeric surfaces to each other.

From the foregoing description, it will be apparent that there has been provided an improved method and apparatus for cleaning particles from a moving web, wherein a contact cleaning roller is oscillated axially of itself and transversely of the web while in rolling contact with a free span of the web. Variations and modifications of the herein described improved method and apparatus, in accordance with the invention, will undoubtedly suggest themselves to those skilled in this art. Accordingly, the foregoing description should be taken as illustrative and not in a limiting sense.

What is claimed is:

1. A system for cleaning particles from a web substrate having first and second surfaces, the web substrate being conveyed along a conveyance path by conveyance rollers and having a free span of said web substrate between adjacent ones of said conveyance rollers, comprising:

a) a first contact cleaning roller rollably disposed transversely against one of said first and second surfaces to be cleaned, said disposition being on said free span of said web, said web being wrapped on said contact cleaning roller at a radial angle of said roller between 0° and about 180°; and b) means for controllably oscillating said contact cleaning roller axially of itself while rolling along said surface to be cleaned, wherein said web is conveyed at a first linear velocity and said contact cleaning roller is oscillated at a second linear velocity, and wherein the ratio of said second velocity to said first velocity is less than 0.01, and wherein tension in said web is greater than 0.5 pound per linear inch of web width.

2. A system in accordance with claim 1 further comprising:

a) a second contact cleaning roller like said first contact cleaning roller disposable against said free span of said web substrate;

b) means for controllably oscillating said second contact cleaning roller axially of itself while rolling along said surface to be cleaned; and c) means for alternating said first and second contact cleaning roller in contact with said web surface to be cleaned.

3. A system in accordance with claim 2 further comprising means for renewing the surface of each of said first and second contact cleaning rollers when said roller is out of web cleaning position.

4. A system in accordance with claim 1 further comprising:

a) a transfer contact cleaning roller parallel to and contactable with said first contact cleaning roller along at least a portion of their mutual length wherein the surface of said transfer contact cleaning roller has a higher tack than the surface of said first contact cleaning roller for transferring particles from the surface of said first contact cleaning roller to the surface of said transfer contact cleaning roller and wherein said transfer contact cleaning roller is not disposable against said web surface; and b) means for oscillating said transfer contact cleaning roller synchronously with said first contact cleaning roller.

5. A system in accordance with claim 4 further comprising means for renewing the surface of said transfer contact cleaning roller.

6. A system in accordance with claim 2 further comprising a second system in accordance with claim 2 disposed for cleaning the other of said first and second surfaces of said web.

7. A system in accordance with claim 4 further comprising a second system in accordance with claim 4 disposed for cleaning the other of said first and second surfaces of said web.

8. A method for cleaning particles from a web substrate having first and second surfaces, comprising the steps of:

a) conveying the web substrate along a conveyance path on conveyance rollers;

b) rolling a first contact cleaning roller along one of said first and second surfaces to be cleaned on a free span of said web substrate between adjacent ones of said conveyance rollers, said web being wrapped on said contact cleaning roller at a radial angle of said roller between 0° and about 180°; and c) controllably oscillating said contact cleaning roller axially of itself while rolling along said surface to be cleaned, said web being conveyed at a first linear velocity and said contact cleaning roller being oscillated at a second linear velocity wherein the ratio of said second velocity to said first velocity is less than about 0.01, and wherein tension in said web is greater than about 0.5 pound per linear inch of web width.

* * * * *